United States Patent [19]

Leland

[11] 4,157,521

[45] Jun. 5, 1979

[54] ROTARY SOLENOID

[75] Inventor: Gerald H. Leland, Dayton, Ohio

[73] Assignee: Ledex, Inc., Dayton, Ohio

[21] Appl. No.: 872,380

[22] Filed: Jan. 26, 1978

[51] Int. Cl.[2] ..... H01F 7/08

[52] U.S. Cl. ..... 335/272; 335/228

[58] Field of Search ..... 335/272, 228, 68, 100, 335/125, 225

[56] References Cited

U.S. PATENT DOCUMENTS

| | | | |
|---|---|---|---|
| 3,027,772 | 4/1962 | Smith | 335/272 |
| 3,264,530 | 8/1966 | Leland et al. | 335/272 |
| 3,743,987 | 7/1973 | Yost | 335/228 |

*Primary Examiner*—Harold Broome

*Attorney, Agent, or Firm*—Biebel, French & Nauman

[57] ABSTRACT

A rotary solenoid has a substantially constant clearance air gap, adapted to proportional operation, includes a generally cup-shaped case of ferromagnetic material, an energizing coil is received in the case adjacent, an annular stator member is received in the open end of said case adjacent said coil and has at least one arcuately formed pole member, an armature has sector-shaped poles corresponding in arcuate spacing and in number to the stator poles, a plate is carried on one end of said armature and defines with the case at least one pair of cooperating non-inclined, arcuately-extending ball bearing recesses, and can conveniently define the extent of rotation of said armature.

3 Claims, 7 Drawing Figures

ROTARY SOLENOID

BACKGROUND OF THE INVENTION

This invention relates to rotary solenoids having constant air gaps and more particularly to a rotary solenoid incorporating a rotary armature plate and captured balls in ball races defining the extent and degree of rotation of the armature.

Many rotary solenoids have been made according to the teachings of the expired U.S. Pat. No. 2,486,880, of Leland in which a fixed assembly includes a housing and an electromagnet, and a movable assembly includes an armature and an output shaft. The armature is movable toward the magnet upon energization of the magnet while the output shaft is connected with the armature for rotation when the armature is attracted by the magnet. A plate is secured to the shaft connected with the armature and arranged in opposed relation to a surface portion of the housing. The plate and the aforesaid surface portion are separated by rotatable elements, preferably balls. The plate or the housing surface, or both of them, are provided with arcuate, inclined recesses presenting cam surfaces arranged with relation to the balls such that the action of the cam surfaces on the balls will cause the plate and armature to rotate when the armature is attracted toward the magnet. Specifically, the plate is normally biased so that a ball is located within the shallow end of its recess, or recesses, as the case may be. Upon attraction of the armature toward the magnet, the balls are forced to roll along their corresponding recesses toward the deeper ends thereof. After each energization of the coil, the shaft and plate are returned to their initial positions with the balls at the shallow ends of the recesses.

One possible disadvantage of the structure defined above is the fact that rotary motion is accompanied by a certain amount of axial motion of the output shaft. An arrangement in a rotary solenoid for eliminating such axial motion is shown in Yost, U.S. Pat. No. 3,743,987 issued July 3, 1973 and assigned to the same assignee as this invention. However, both Yost and Leland employ a solenoid structure which has an axially closing air gap or, in other words, an air gap which varies in spacing with the rotation of the shaft. Another advantage of the non-inclined raceway structure as compared to the use of inclined raceways is that the solenoid of the present invention is balanced and is therefore shockproof.

Attempts to increase the stroke or provide for linear operation and at the same time eliminate axial motion of the shaft include the U.S. Pat. No. 3,435,394 of Egger, issued Mar. 24, 1969; Myers, U.S. Pat. No. 3,750,065 issued July 31, 1973 and Sommers, U.S. Pat. No. 3,753,180 issued Aug. 14, 1973, each assigned to the same assignee as this invention. In each of these patents an armature is attached to the shaft and rotates between an axially opposed pair of pole members, and either external or internal stop means are provided to define and limit the desired extent of rotation. Further, the armature shafts have been journeyed at each opposite end of the magnetic structure requiring two axially spaced sleeve bearings to support the armature.

The present invention incorporates certain of the best features of the Leland rotary solenoid in which ball bearing races define the extent of rotation, and yet utilizes a rotor and stator assembly which have a constant-dimension or clearance air gap, permitting proportional operation. For this purpose, an armature is mounted on a shaft for rotation on a single bearing sleeve at one axial end of the magnetic structure, and carries an armature plate at the other end exteriorly of the magnetic case. The plate and exterior surface of the case are provided with one or more arcuately cooperating ball raceways. However, rather than providing axially inclined ball raceways as taught by Leland, the ball recesses are preferably true to a plane perpendicular to the axis of the shaft; that is, they are not inclined. The armature carries one or more arcuately spaced poles and rotates within a stator structure having a corresponding number of poles, defining radially disposed air gaps between the armature and stator poles. The air gaps remain constant in radial dimension as the armature moves between defined extreme positions from one in which the cooperating poles are just beginning to overlap to one in which the cooperating poles are substantially overlapped.

The angular extent of rotation of the output shaft is preferably defined by the available movement of the armature plate on the ball races and the shaft movement is approximately twice the arcuate extent of the cooperating races in either the case or the armature plate. The limits of rotation are defined when the balls come to their respective ends of the raceways. Maintenance of rolling contact of the armature plate on the balls is assured by a snap ring on the shaft and further by reason of the fact that there is a net axial attracting force tending to draw the armature into the case, during actuation, and thereby urging the armature plate against the balls in their respective raceways.

Accordingly, it is an object of this invention to provide a constant air gap rotary solenoid in which the rotary motion is carried and defined by arcuate raceways and balls therebetween in low-friction rolling contact.

Another object of the invention is the provision of a rotary solenoid having a non-axial moving shaft using many of the same components as conventional rotary solenoids, yet having a constant air gap and providing for a proportional operation.

These and other objects and advantages of the invention will be apparent from the following description, the accompanying drawings and the appended claims.

DESCRIPTION OF THE PREFERRED EMBODIMENTS

Figure 1:
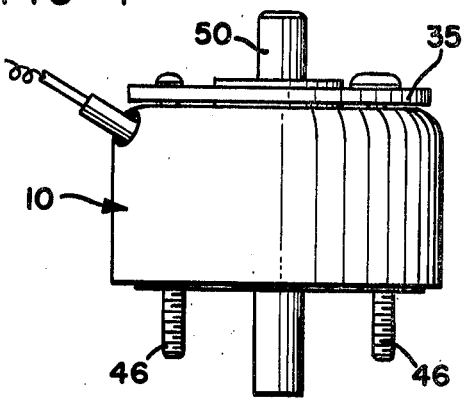
FIG. 1 is an elevational view of a solenoid according to this invention.
Figure 2:
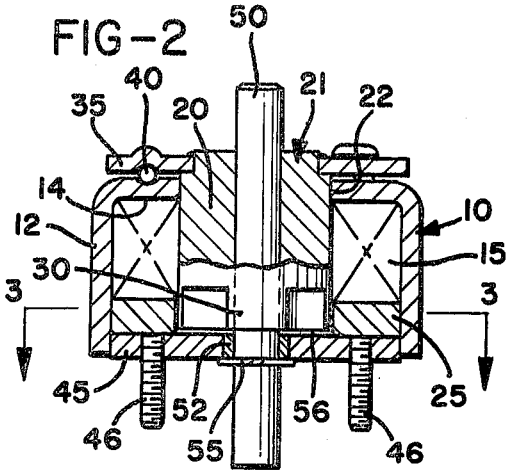
FIG. 2 is a vertical section therethrough.

Referring to FIGS. 1 and 2, a rotary solenoid is shown as having a generally cup-shaped case 10. The case 10 is made of ferromagnetic material and includes a generally cylindrical sleeve portion 12 and a generally radial end wall 14. An annular energizing coil 15 is received within the case 10 adjacent the inside surface of the end wall 14.

An armature 20 of ferromagnetic material is rotatably received within the case 10 and includes an upper portion 21 which extends through a central opening 22 formed in the radial wall 14 of the case 10.

Figure 3:
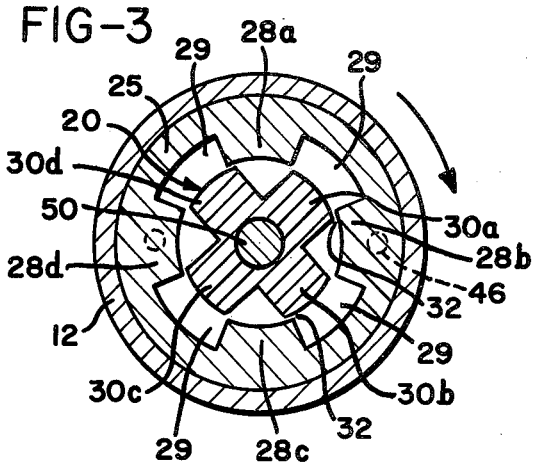
FIG. 3 is a transverse section taken generally along the line 3—3 of FIG. 2, showing the armature in the start position.

An annular stator 25 also formed of ferromagnetic material is press-fitted within the case 10 in abutment with the coil 15. The stator 25 has at least one arcuately extending pole 28 thereof, and the stator 25 is shown in FIG. 3 as having four equal, arcuately-extending pole portions 28*a*, 28*b*, 28*c* and 28*d*. The individual poles are separated from each other by equally sized and spaced arcuately defined slots or openings 29.

The armature 20 is formed at the end opposite from the upper end 21 with corresponding poles 30. Thus, the armature is shown in FIG. 3 as having arcuately extending poles 30*a*, 30*b*, 30*c* and 30*d*. Each of the armature poles 30 extend approximately the same arcuate extent and have the same angular spacing as that of the poles 28. While a four pole construction is shown it is in the scope of the invention to have greater than four or as few as one stator pole 28 and one corresponding armature pole 30.

Figure 4:
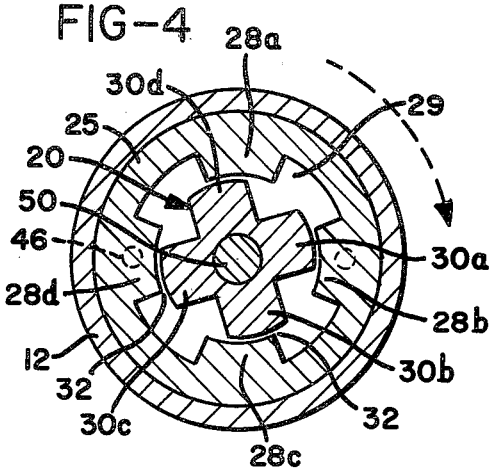
FIG. 4 is a section similar to FIG. 3, but showing the armature in a moved position.

The poles 30 and 28 are radially disposed and thereby define therebetween a substantially constant clearance air gap, as shown at 32 in FIGS. 3 and 4. In other words, the air gap 32 may be considered as a radial air gap and does not substantially change in dimension or in clearance with relative rotation of the armature and stator poles from a position in which the poles are just beginning to overlap as shown in FIG. 3 to a position in which the poles are substantially aligned with each other as shown in FIG. 4.

Figure 5:
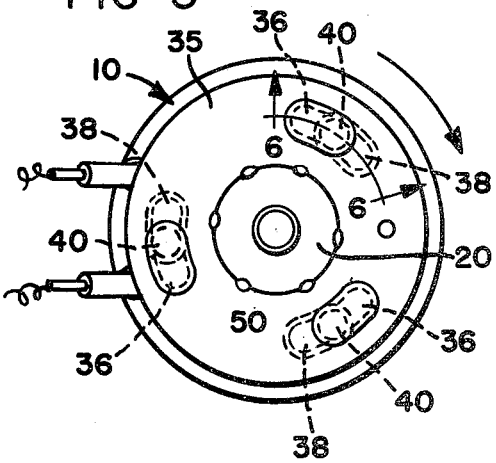
FIG. 5 is a top plan view.
Figure 6:
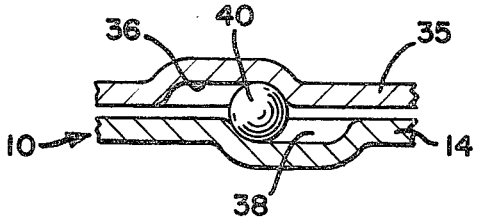
FIG. 6 is an enlarged fragmentary section taken generally along the line 6—6 of FIG. 5.

The armature portion 21 carries and supports an armature plate 35 exteriorly of the case 10. The armature plate 35 has formed therein a plurality of arcuately extending recesses 36 as shown in FIGS. 5 and 6. Also, the outer surface of the case wall 14 is formed with a corresponding plurality of arcuately extending recesses 38 thereby defining cooperating pairs of arcuately extending recesses. The ball-receiving recesses are in a plane normal to the axis of rotation of the armature 20 and are thus not inclined or tilted with respect to the axis of rotation. For each pair of recesses a ball is received therebetween, as shown in FIG. 6. Thus, the extent of rotation of the plate 35 and and the armature 20 is defined by the arcuate extent of the cooperating pairs of recesses 36 and 38 and the intervening balls 40. One such limit of rotation is shown in FIG. 6 in which the ball 40 is rolled into abutting contact with the opposite arcuate ends of the cooperating recesses. The recesses are so aligned on the plate 35 as to define the beginning and ending extents of rotation of the armature within the case. The starting position, "de-energized" or "rest" position is shown in FIG. 3 in which the corresponding armature poles 30 are just beginning to overlap the stator poles 28. The actuated or "moved" position is shown as being approached in FIG. 4, with the arrow indicating the direction of rotation. Preferably, the fully actuated or fully-energized position is one in which end pole 30 is almost completely in radial alignment with one of the stator poles 28.

The case 10 is closed by a non-magnetic or non-ferrous closure plate 45 as shown in section in FIG. 2. The closure plate 45 is held by an interference fit within the case 12 and receives threaded mounting studs 46. The studs 46 are held in the plate 45 by any conventional means, such as by staking or bonding.

An output shaft 50 is extended through the armature 20 and is piloted on the closure plate 45 by a sleeve bearing 52. A snap-ring 55 may be positioned within a suitable groove on the shaft 50 exteriorly of the closure plate 45 to define the running position of the armature. If desired, the shaft 50 may also extend through the upper end of the armature, as shown in FIGS. 1 and 2. The bearing 52 cooperates with the ball races and balls to define two axially-spaced supports for the rotation of the armature. The bearing 52 thus defines the concentric relation of the armature within the stator at the lower end of the solenoid, as viewed in FIG. 2, while the arcuate ball races and balls support the upper end of the armature for rotation concentrically with respect to the case 10.

It is desirable to provide an axial loading on the balls 40 within the recesses 36 and 38, to assure that the balls will, at all times, track in their recesses and will not otherwise move or slide and thus cause wear on the adjacent parts. For this purpose there is provided a net attraction, when current is applied to the coil 15, urging the armature 20 in the direction of the plate 45. A slight gap as shown at 56 in FIG. 2 is provided for running clearance, and this gap also defines the extent of axial offset between the stator and the armature. Thus there is a small net force tending to move the armature in such a direction as to close the gap 56. In addition, if desired, the armature plate 35 may also be made of magnetic material and since the plate 35 is spaced from the case, there will be an attraction between the plate 35 and the adjacent radial wall 14 of the case 12. Either of these forces, or the combined forces, provide an axial loading on the balls. This rolling contact is almost friction-free, thus reducing sticking friction known in the trade by the coined word "stiction", thereby narrowing the hysterisis loop and improving the proportionality.

It is also within the scope of this invention to provide full circle, annular recesses 36 and 38 containing a plurality of balls which may be spaced or caged in a conventional manner, in which event an external stop defining the limits of rotation can be used. One such external stop is shown in the U.S. Pat. No. 3,750,065, of Myers, identified above.

In operation, the poles 30 of the armature 20 may be moved to a retracted position as shown in FIG. 3 by any suitable means, such as by a coiled retraction spring, not shown. In the fully de-energized or retracted position shown there will be a slight overlapping of the poles, which may be less than one to four degrees, providing an initially high starting torque. When energized, the armature poles will attempt to align themselves with the stator poles, and the armature will rotate in the direction of the arrow as shown in FIG. 4 to the point where the respective poles are fully aligned. The arcuate extent of the cooperating pairs of recesses 36 and 38 with the balls 40 serves to define the total permitted rotation, including the start position in which the respective or corresponding poles are slightly overlapped as defined above. The end of the stroke is defined at a position slightly moved beyond that shown in FIG. 4, in which the poles are not quite fully overlapped. Thus, in the embodiment shown in FIGS. 4 and 5, about 25° of rotation may be effected to provide a substantially proportional characteristic, that is, to provide a torque, or an armature position which is proportional with respect to the current in the coil; or, to provide a rate of armature rotation which is proportional with respect to a change of current in the coil.

Figure 7:
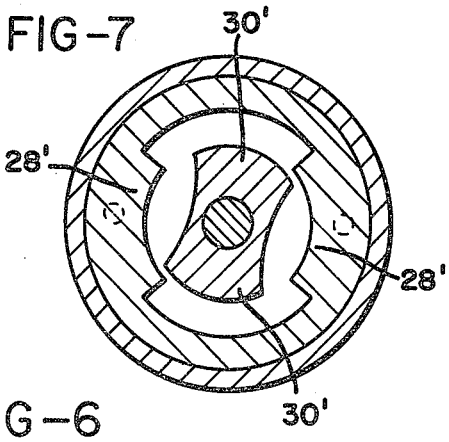
FIG. 7 is a transverse section similar to that of FIG. 3 showing a slightly modified form of the invention to generate a longer rotary stroke.

A two-pole embodiment is shown in FIG. 7 which is the same in all material respects as the preceding but in which the armature is provided with only two poles 30' and the stator is provided with corresponding pairs of poles 28'. In this embodiment, about 85° of rotation are provided, and it is understood that the recesses 36 and 38 are arcuately extended to accommodate the desired extent of rotation, and to define the stopped positions of the armature.

While the forms of apparatus herein described constitute preferred embodiments of this invention, it is to be understood that the invention is not limited to these precise forms of apparatus, and that changes may be made therein without departing from the scope of the invention.

What is claimed is:

1. A rotary solenoid having a substantially constant-dimension air gap, comprising a generally cup-shaped case of ferromagnetic material having a sleeve portion and having an end portion defining therein an armature receiving opening, an energizing coil received in said case adjacent the inside surface of said end portion, an annular stator member received in said case adjacent said coil having at least one arcuately formed pole member, an armature received in said case having sector-shaped poles corresponding in arcuate spacing and in number to said stator poles, the poles on said armature being positioned radially within the poles on said stator and defining with said stator poles an air gap which remains relatively constant as each armature pole moves past its corresponding stator pole, plate means carried on one end of said armature exteriorly of said case end portion, means in said plate means and said case defining at least one pair of cooperating non-inclined arcuately-extending ball recesses, a ball received in each of said recess pairs, the arcuate extent of said recess pairs defining with said balls the extent of angular rotation of said armature in said case, a shaft on said armature, closure means closing the open end of said case, and bearing means in said closure means rotatably supporting said shaft.

2. A rotary solenoid of claim 1 further comprising means defining an air gap between said plate means and said case creating a net magnetic force tending to hold said plate means in contact with said balls in said recesses when said coil is energized.

3. A rotary solenoid having a substantially constant-dimension air gap adapted to proportional operation, comprising a generally cup-shaped case of ferromagnetic material having a generally cylindrical sleeve portion and having a generally radial end wall defining therein an armature receiving opening, an energizing coil received in said case adjacent the inside surface of said end wall, an annular stator member received in the open end of said case adjacent said coil having a plurality of arcuately formed pole members, an armature received in said case having one end thereof extended through said radial wall opening and having sector-shaped poles corresponding in arcuate spacing and in number to said stator poles, the poles on said armature positioned radially within the poles on said stator and each defining with said stator poles an air gap which remains relatively constant as each armature pole moves past its corresponding stator pole, a plate carried on said one end of said armature exteriorly of said radial case wall, means in said plate and in the outer surface of said radial wall defining pairs of cooperating non-inclined arcuately extending ball recesses, a ball received in each of said recess pairs, the arcuate extent of said recess pairs defining with said balls the extent of permitted angular rotation of said armature in said case, said balls and recesses serving to guide and support said armature one end with rotation thereof, an output shaft on said armature, a closure plate positioned exteriorly of said stator and closing the open end of said case, and bearing means in said closure plate rotatably supporting said shaft therein defining with said balls and recesses a second rotary support for said armature.

* * * * *